US011591870B1

(12) United States Patent
Kelly, III et al.

(10) Patent No.: US 11,591,870 B1
(45) Date of Patent: Feb. 28, 2023

(54) METHODS AND APPARATUSES FOR GAINING REENTRY BELOW ABANDONED PACKERS

(71) Applicant: Saudi Arabian Oil Company, Dhahran (SA)

(72) Inventors: Benton L Kelly, III, Castle Rock, CO (US); Ahmed A Ramadhan, Dammam (SA); Ahmed A Mousa, Doha (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/464,976

(22) Filed: Sep. 2, 2021

(51) Int. Cl.
*E21B 23/02* (2006.01)
*E21B 31/18* (2006.01)
*E21B 23/00* (2006.01)

(52) U.S. Cl.
CPC ..... *E21B 23/02* (2013.01); *E21B 31/18* (2013.01); *E21B 23/006* (2013.01)

(58) Field of Classification Search
CPC ..... E21B 23/02; E21B 23/006; E21B 31/18; E21B 33/072
See application file for complete search history.

(56) References Cited

U.S. PATENT DOCUMENTS 2,970,859 A 2/1961 Justice
3,191,981 A * 6/1965 Osmun ..... E21B 31/18 294/99.1
3,727,967 A 4/1973 Anastasiu et al.
4,101,157 A 7/1978 Richey
4,156,460 A * 5/1979 Crowe ..... E21B 33/1293 166/134
5,033,550 A 7/1991 Johnson et al.
5,242,201 A * 9/1993 Beeman ..... E21B 31/20 294/86.15
5,318,121 A 6/1994 Brockman et al.
(Continued)

FOREIGN PATENT DOCUMENTS

CN 1260457 C 6/2006
WO 9809047 A1 3/1998

OTHER PUBLICATIONS

Saigao, "DYLT-T Type Series 70 Short Catch Overshot", https://www.saigaogroup.com/product/dylt-t-type-series-70-short-catch-overshot.html, Obtained from Website Mar. 17, 2021.
(Continued)

*Primary Examiner* — D. Andrews
(74) *Attorney, Agent, or Firm* — Dinsmore & Shohl LLP

(57) ABSTRACT

A reentry guide tool includes an overshot defining a lower end and comprises a bowl and grapple. The bowl defines an interior space of the overshot, and the grapple is disposed in the bowl and is operable to engage a tubular. A tubular guide nipple has a downhole and an uphole end, the downhole end complementary to the overshot and the uphole end complementary to the reentry guide. The guide nipple is operable to connect and provide a transition between the overshot and reentry guide. The reentry guide is a tubular piece having an uphole end with a bevel. A deployment mechanism is defined on the overshot, reentry guide, or guide nipple, and is operable to connect the reentry guide to a running tool for deployment. A method of providing a transition from a first to a second tubular in a wellbore is also provided.

14 Claims, 4 Drawing Sheets

(56) References Cited

U.S. PATENT DOCUMENTS

| | | | | |
|---|---|---|---|---|
| 6,279,659 | B1 | 8/2001 | Brunet | |
| RE37,867 | E | 10/2002 | Gondouin | |
| 2015/0060048 | A1* | 3/2015 | Henning | E21B 33/072 166/181 |
| 2018/0209234 | A1 | 7/2018 | Manera et al. | |

OTHER PUBLICATIONS

Schlumbarger, "Wireline Adapter Kit: Connects the MDF and MDFBB permanent production packers to a wireline assembly", slb.com/packers, 14-CO,0201, 2014.

Notification of Transmittal of the International Search Report and the Written Opinion of the International Searching Authority, or the Declaration dated Nov. 24, 2022 pertaining to International application No. PCT/US2022/041814 filed Aug. 29, 2022, 12 pages.

* cited by examiner

METHODS AND APPARATUSES FOR GAINING REENTRY BELOW ABANDONED PACKERS

FIELD

The present disclosure relates to drilling tools and, more specifically, to methods and apparatuses for gaining reentry below abandoned packers or any tubular shape left in the well.

BACKGROUND

During the life of a well, such as during workover, it may be necessary to orphan a packer or other piece of equipment in the well due to various circumstances. Orphaning a packer or other piece of equipment may include cutting the tubing above the packer or other piece of equipment and retrieving the tubing above the abandoned equipment. Doing so leaves a stub of cut tubing sticking up above the abandoned packer or other piece of equipment. Occasionally, it may be necessary to access below the abandoned packer or other piece of equipment, but the stub of cut tubing makes this extremely difficult. Accordingly, there is an ongoing need for methods and apparatuses that effectively and efficiently allow one to gain access below an abandoned packer or other piece of equipment through a stub of cut tubing. As further discussed herein, embodiments of the present disclosure meet this need and enhance the ability to access stubs of cut tubing above an abandoned packer or other piece of equipment, allowing access below an abandoned packer or other piece of equipment.

BRIEF SUMMARY

According to one or more aspects of the present disclosure, a reentry guide tool may include an overshot defining a lower end of the reentry guide tool and including a bowl and a grapple. The bowl may define an interior space of the overshot, and the grapple may be disposed in the bowl and being operable to engage a tubular. A guide nipple may be a tubular piece having a downhole end and an uphole end. The downhole end may be complementary to the overshot and the uphole end may be complementary to the reentry guide. The guide nipple may be operable to connect and provide a transition between the overshot and the reentry guide. A reentry guide may be a tubular piece having an uphole end with a bevel. A deployment mechanism may be defined on any one of the overshot, the reentry guide, or the guide nipple, and the deployment mechanism may be operable to connect the reentry guide to a running tool for deployment of the reentry guide tool.

According to one or more other aspects of the present disclosure, a method of providing a transition from a first tubular to a second tubular may include providing a reentry guide tool having an overshot defining a lower end of the guide tool, a reentry guide defining an upper end of the guide tool, a guide nipple connecting and providing a transition between the overshot and the reentry guide, and a deployment mechanism. The deployment mechanism of the reentry guide tool may be attached to a running tool. The running tool with the attached guide tool may be routed into the first tubular in the wellbore to a deployment site, and the deployment site may be an area in the wellbore having a transition from the first tubular to the second tubular. A grapple of the overshot of the guide tool may be attached to a location at or near the second tubular, and the grapple may be disposed in a bowl defining an interior space of the overshot. A transition from the first tubular to the guide tool may be provided with a bevel defining an uphole end of the reentry guide. A transition from the guide tool to the second tubular may be provided with the overshot.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

The present disclosure is directed to methods and apparatuses for gaining reentry below abandoned packers. Conventional methods of gaining reentry below abandoned packers are not efficient as they require fishing or "stabbing" at the downhole, smaller tubular. Embodiments of the present disclosure meet a demand for more efficient methods and apparatuses for gaining reentry below abandoned packers. The present embodiments include a reentry guide tool having an overshot and a reentry guide, which may allow the reentry guide tool to attach to a downhole, smaller tubular and provide a smooth transition from the uphole, larger tubular through the reentry guide to the smaller, downhole tubular. Embodiments of the present disclosure, as further described herein, avoid the need for fishing or "stabbing" at the downhole, smaller tubular and provide a much smoother, efficient, and effective transition from the uphole tubular to the downhole tubular.

It is contemplated that the methods and apparatuses of the present disclosure are not limited in applicability to gaining reentry below abandoned packers. The methods and apparatuses of the present disclosure may be applicable to gaining reentry below other pieces of equipment where there is a transition in the size of the tubulars.

As used in the present disclosure, a "packer" may refer to any device that can be run into a wellbore with a smaller initial outside diameter that then expands externally to seal the wellbore. As those skilled in the art will appreciate, the packer may support a second, smaller tubular extending further downhole in the wellbore.

Figure 1:
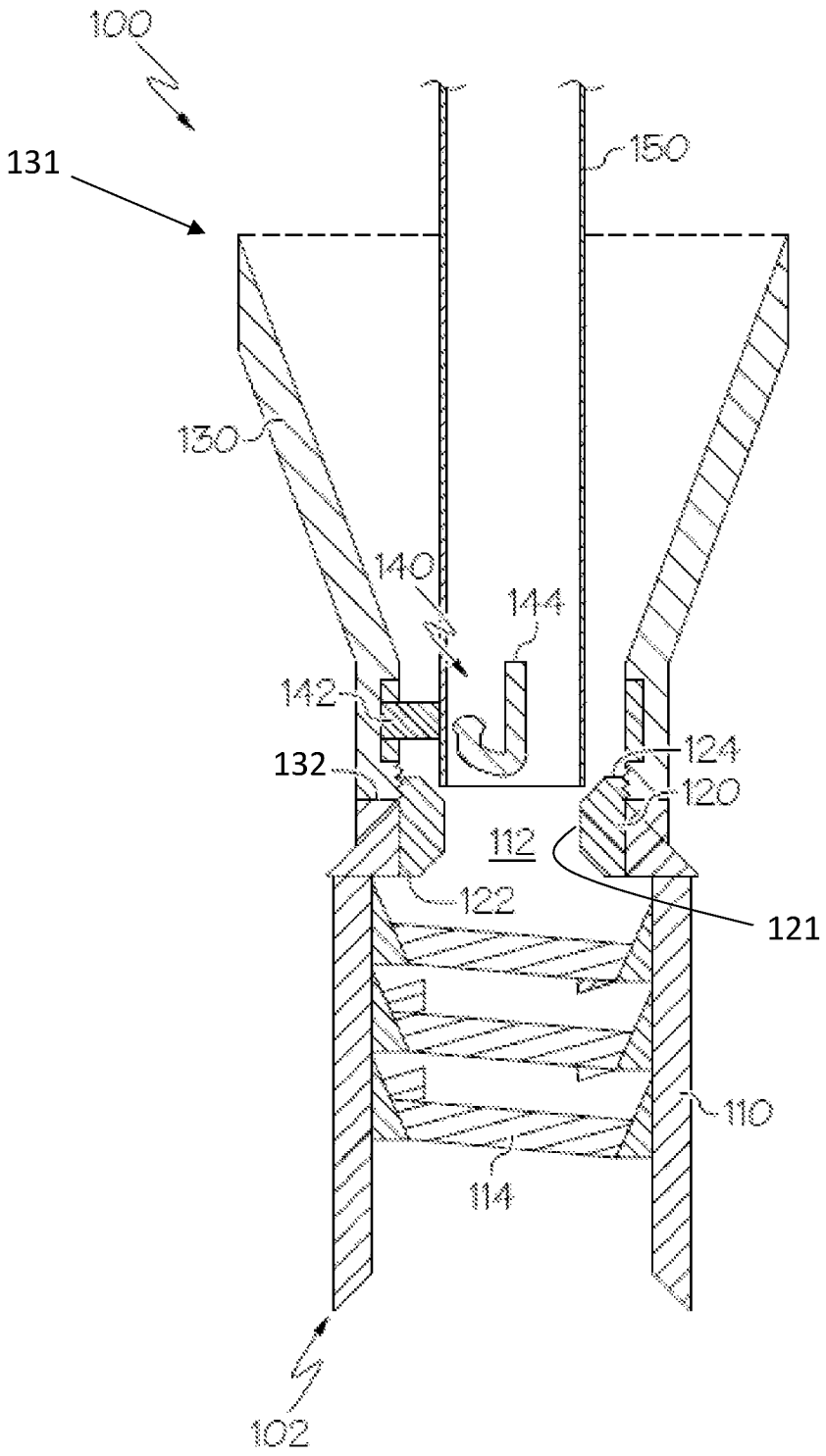
FIG. 1 schematically depicts a cross-sectional view of a reentry guide tool and running tool.

Referring initially to FIG. 1, a reentry guide tool 100 may include an overshot 110, a guide nipple 120, a reentry guide 130, and a deployment mechanism 140. The overshot 110 may define a lower end 102 of the reentry guide tool 100. The overshot 110 may include a bowl 112 and a grapple 114. The bowl 112 may define an interior space of the overshot 110. The grapple 114 may be disposed in the bowl 112. The grapple 114 may be operable to engage a tubular. The reentry guide 130 may include a tubular piece having an uphole end 131 with a bevel. The guide nipple 120 may include a tubular piece having a downhole end 122 and an uphole end 124. The downhole end 122 of the guide nipple 120 may be complementary to the overshot 110. The uphole end 124 of the guide nipple 120 may be complementary to the reentry guide 130. The guide nipple 120 may be operable to connect and provide a transition between the overshot 110 and the reentry guide 130. The deployment mechanism 140 may be defined on any one of the overshot 110, the reentry guide 130, or the guide nipple 120. The deployment mechanism 140 may be operable to connect the reentry guide 130 to a running tool for deployment of the reentry guide tool 100.

The overshot 110 of the reentry guide tool 100 is a downhole tool that may be used in fishing operations to engage on the outside surface of a tube or tool. As previously stated, the overshot 100 may include the bowl 112 and the grapple 114. The grapple 114 of the overshot 110 may grip the outside surface of the tube or tool. In examples, an inner diameter of the bowl 112 of the overshot 110 is equal to the inner diameter of the tubular that is being engaged. In further examples, the inner diameter of the overshot 110 may be greater than the inner diameter of the tubular. The overshot 110 may be any conventional or yet-to-be developed overshot 110. In an example, a standard overshot from Bowen, such as a Series 150 overshot, may be used. The grapple 114 may be a spiral grapple or a basket grapple or any other conventional or yet-to-be developed grapple. In embodiments, the grapple 114 is a spiral grapple.

Still referring to FIG. 1, the deployment mechanism 140 may be a J-slot type mechanism having an actuating pin 142. As further described in the present disclosure, a running tool 150 may be used to deploy the reentry guide tool 100. The deployment mechanism 140 may also include a J-slot profile 144. The actuating pin 142 may be slidably housed within the J-slot profile 144. The J-slot profile 144 may be on the running tool 150. The actuating pin 142 may include a circular-shaped or a diamond-shaped extension from any one of the overshot 110, the reentry guide 130, or the guide nipple 120. In embodiments, the actuating pin 142 may be defined on the overshot 110 and the J-slot profile 144 may be defined on the running tool 150 used to deploy the reentry guide 130. The deployment mechanism 140 may be machined at or near a downhole end 132 of the reentry guide 130. Alternatively, the actuating pin 142 may be defined on the running tool 150 used to deploy the reentry guide 130 and the J-slot profile 144 may be defined on the overshot 110.

The bevel of the reentry guide 130 may include an angle from greater than 5 degrees from vertical to less than 50 degrees from vertical. The bevel may serve to provide a smooth transition from a first tubular (e.g., the uphole, larger tubular) to a second tubular (e.g., the downhole, smaller tubular). The reentry guide 130 may be connected to the overshot 110 using any conventional or yet-to-be developed means.

Still referring to FIG. 1, an inner diameter of the guide nipple 120 may be less than or equal to an inner diameter of the overshot 110. Additionally or alternatively, an inner diameter of the guide nipple 120 may be less than or equal to an inner diameter of the reentry guide 130. In embodiments, the downhole end 122, the uphole end 124, or both of the guide nipple 120 comprise a female connector 121. In embodiments, the guide nipple 120 may be welded to the overshot 110, the reentry guide 130, or both.

The reentry guide tool 100 may be formed as a unitary body. That is, any two or three of the overshot 110, the guide nipple 120, or the reentry guide 130 may be formed from a unitary body.

Figure 2:
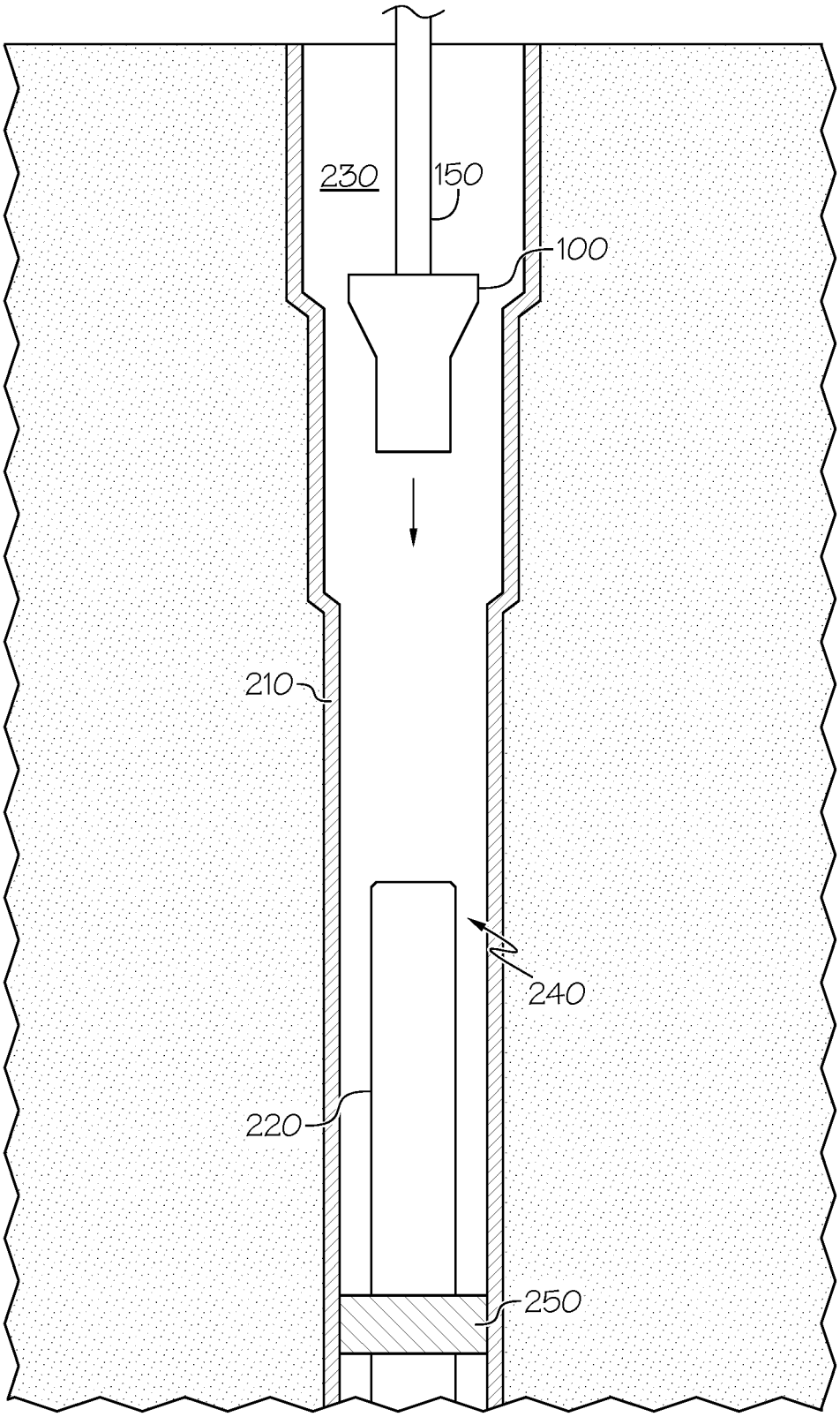
FIG. 2 schematically depicts deployment of a reentry guide tool in a wellbore.
Figure 3:
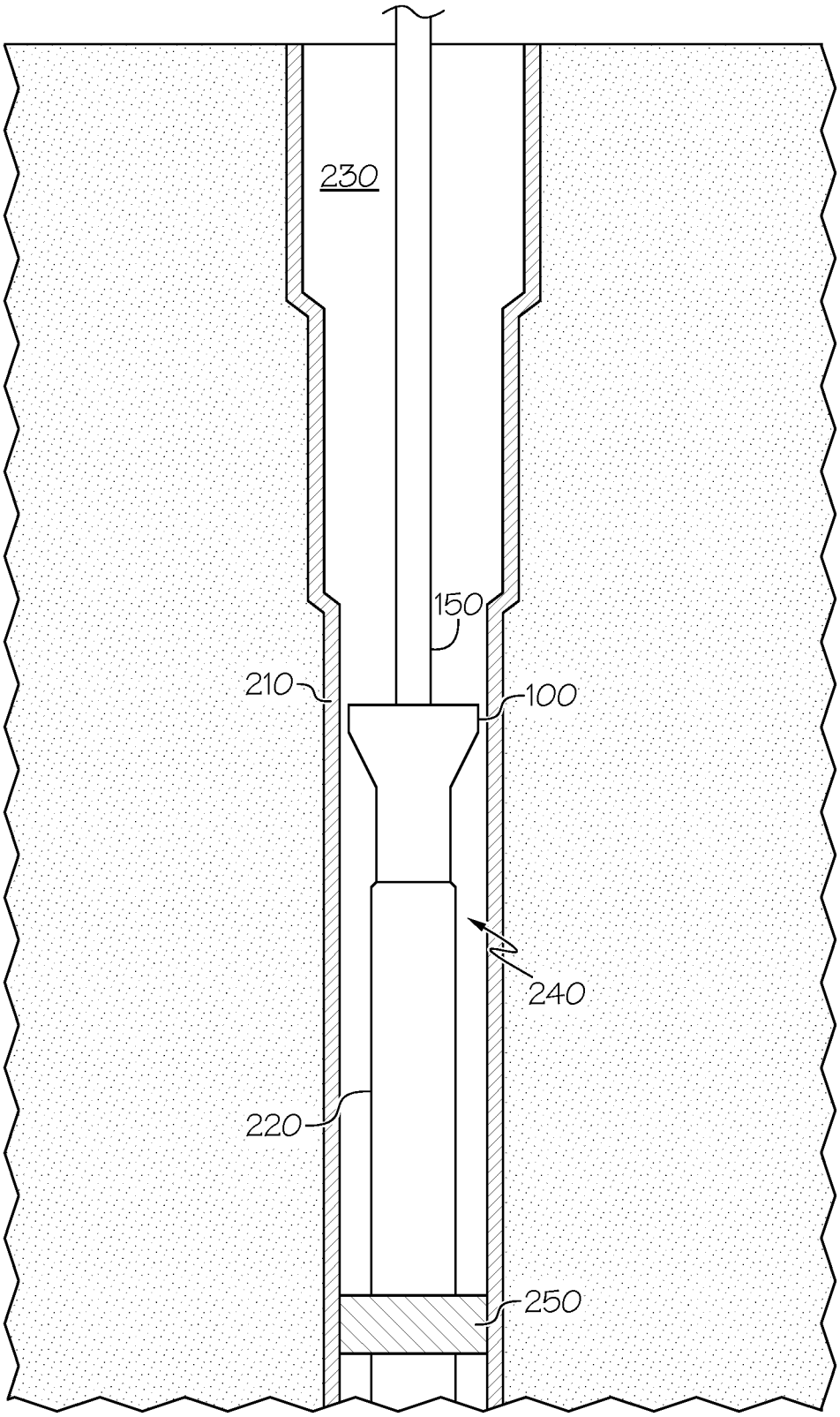
FIG. 3 schematically depicts installation of a reentry guide tool in a wellbore.
Figure 4:
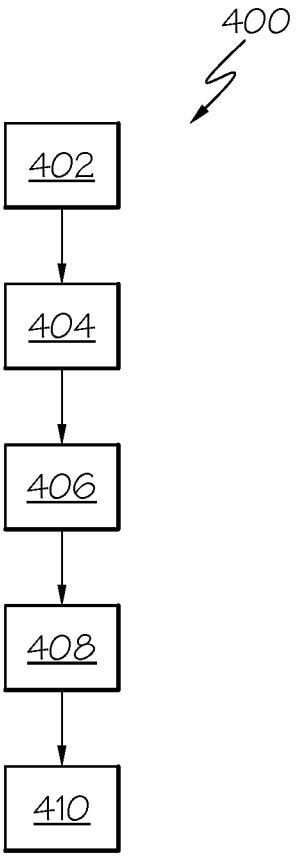
FIG. 4 is a flowchart for a method of installing a reentry guide tool.

Referring now to FIGS. 2 and 3, the present disclosure is also directed to methods of providing a transition from a first tubular 210 to a second tubular 220. During the life of a well, such as during workover, it may be necessary to orphan a packer or other piece of equipment in the well due to various circumstances. Orphaning a packer or other piece of equipment may include cutting the tubing above the packer or other piece of equipment and retrieving the tubing above the abandoned equipment. Doing so leaves a stub of cut tubing sticking up above the abandoned packer or other piece of equipment. Occasionally, it may be necessary to access below the abandoned packer or other piece of equipment, but the stub of cut tubing makes this extremely difficult.

In embodiments, a method of providing a transition from a first tubular 210 to a second tubular 220, such as a stub of cut tubing, may include attaching a reentry guide tool 100 to a running tool 150 and routing the running tool 150 into a first tubular 210 in a wellbore 230 to a deployment site 240. Referring again to FIG. 1, the reentry guide tool 100 may have any feature or function as previously described in the present disclosure. Referring again to FIGS. 2 and 3, the deployment site 240 may be an area in the wellbore having a transition from the first tubular 210 to the second tubular 220. The method may also include attaching the grapple 114 of the overshot 110 of the reentry guide 130 to a location at or near the second tubular 220 (e.g., the deployment site 240). The bevel of the reentry guide 130 of the reentry tool may provide a transition from the first tubular 210 to the reentry guide tool 100. The overshot 110, the guide nipple 120, or both of the reentry guide 130 may provide a transition from the reentry guide 130 to the second tubular 210.

The method may further include disengaging the running tool 150 from the reentry guide tool 100. Disengaging the running tool 150 may include guiding a male end of the deployment mechanism 140 along a female track of the deployment mechanism 140 such that the running tool 150 and the reentry guide tool 100 detach. The male end of the deployment mechanism 140 may be the actuating pin 140. The female end of the deployment mechanism 140 may be the J-slot profile 144. The deployment mechanism 140, including the actuating pin 142 and the J-slot profile 144, may have any feature or function as previously described in the present disclosure In embodiments, the second tubular 220 may be a stub of pipe extending uphole from a packer 250. The running tool 150 used to deploy the reentry guide tool 100 may be pipe, such as drill pipe, or coiled tubing. It is contemplated that any conventional or yet-to-be developed tool may be used to deploy the reentry guide tool 100 so long as the running tool 150 has sufficient weight and/or rigidity to disengage the reentry guide tool 100 via the deployment mechanism 140.

Once the reentry guide tool 100 is deployed and the running tool 150 is removed from the wellbore 230, the method may further include running a workover line (not shown) from the first tubular 210, through the reentry guide tool 100, and into the second tubular 220. The workover line may include, but is not limited to, one or more of jointed tubing, coiled tubing, E-line, or slickline.

Referring to FIGS. 1-4, methods of the present disclosure may be summarized by a series of steps. First, step 402 may include attaching the reentry guide tool 100 to the running tool 150. Second, step 404 may include routing the running tool 150, to which the reentry guide tool 100 is attached, into a first tubular 210 in the wellbore 230 to the deployment site 240. After step 404, step 406 may include attaching the grapple 114 of the reentry guide tool 100 to a location at or near the second tubular 220. In some embodiments, step 408 may include disengaging the running tool 150 from the reentry guide tool 100. Finally, in some embodiments, step 410 may include running a workover line (not shown) from the first tubular 210, through the reentry guide tool 100, and into the second tubular 220, as the reentry guide tool 100 may provide a smooth transition from the first tubular 210 to the second tubular 220.

One or more aspects of the present disclosure are described here. A first aspect of the present disclosure may include a reentry guide tool with an overshot defining a lower end of the reentry guide tool and including a bowl and a grapple. The bowl may define an interior space of the overshot, and the grapple may be disposed in the bowl and being operable to engage a tubular. A guide nipple may be a tubular piece having a downhole end and an uphole end. The downhole end may be complementary to the overshot and the uphole end may be complementary to the reentry guide. The guide nipple may be operable to connect and provide a transition between the overshot and the reentry guide. A reentry guide may be a tubular piece having an uphole end with a bevel. A deployment mechanism may be defined on any one of the overshot, the reentry guide, or the guide nipple, and the deployment mechanism may be operable to connect the reentry guide to a running tool for deployment of the reentry guide tool.

A second aspect of the present disclosure may include the first aspect, wherein the grapple is a spiral grapple.

A third aspect of the present disclosure may include the first aspect, wherein an inner diameter of the bowl of the overshot is greater than or equal to an interior diameter of the tubular to be engaged A fourth aspect of the present disclosure may include the first aspect, wherein the deployment mechanism is a J-slot type mechanism comprising a J-slot profile and an actuating pin.

A fifth aspect of the present disclosure may include the fourth aspect, wherein the actuating pin comprises a circular-shaped or a diamond-shaped extension from any one of the overshot, the reentry guide, or the guide nipple.

A sixth aspect of the present disclosure may include the fourth aspect, wherein the actuating pin is defined on the overshot and the J-slot profile is defined on a running tool used to deploy the reentry guide.

A seventh aspect of the present disclosure may include the first aspect, wherein the bevel of the reentry guide comprises an angle from greater than 5 degrees from vertical to less than 50 degrees from vertical.

An eighth aspect of the present disclosure may include the first aspect, wherein an inner diameter of the guide nipple is less than or equal to an inner diameter of the overshot.

A ninth aspect of the present disclosure may include the first aspect, wherein an inner diameter of the guide nipple is less than or equal to an inner diameter of the reentry guide.

A tenth aspect of the present disclosure may include the first aspect, wherein the downhole end, the uphole end, or both of the guide nipple comprise a female connector.

An eleventh aspect of the present disclosure may include the first aspect, wherein the guide nipple is welded to the overshot, the reentry guide, or both.

A twelfth aspect of the present disclosure may include the first aspect, wherein any two or three of the overshot, the guide nipple, or the reentry guide are formed from a unitary body.

A thirteenth aspect of the present disclosure may include a method of providing a transition from a first tubular to a second tubular may include providing a reentry guide tool having an overshot defining a lower end of the guide tool, a reentry guide defining an upper end of the guide tool, a guide nipple connecting and providing a transition between the overshot and the reentry guide, and a deployment mechanism. The deployment mechanism of the reentry guide tool may be attached to a running tool. The running tool with the attached guide tool may be routed into the first tubular in the wellbore to a deployment site, and the deployment site may be an area in the wellbore having a transition from the first tubular to the second tubular. A grapple of the overshot of the guide tool may be attached to a location at or near the second tubular, and the grapple may be disposed in a bowl defining an interior space of the overshot. A transition from the first tubular to the guide tool may be provided with a bevel defining an uphole end of the reentry guide. A transition from the guide tool to the second tubular may be provided with the overshot.

A fourteenth aspect of the present disclosure may include the thirteenth aspect, further comprising disengaging the running tool from the reentry guide tool, wherein disengaging the running tool comprises guiding a male end of the deployment mechanism along a female track of the deployment mechanism such that the running tool and the reentry guide detach.

A fifteenth aspect of the present disclosure may include the thirteenth aspect, further comprising running a workover line from the first tubular, through the reentry guide tool, and into the second tubular.

It is also noted that recitations herein of "at least one" component, element, etc., should not be used to create an inference that the alternative use of the articles "a" or "an" should be limited to a single component, element, etc. For example, the use of "at least one fluid control valve" should not be interpreted to mean that the wellhead can only include one fluid control valve.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A reentry guide tool comprising:

an overshot defining a lower end of the reentry guide tool and comprising a bowl and a grapple, the bowl defining an interior space of the overshot, and the grapple disposed in the bowl and being operable to engage a tubular;

a reentry guide comprising a tubular piece having an uphole end with a bevel;

a guide nipple comprising a tubular piece having a downhole end and an uphole end, the downhole end of the guide nipple being sized complementary to an uphole end of the overshot and the uphole end of the guide nipple being sized complementary to a downhole end of the reentry guide, the guide nipple being operable to connect and provide a transition between the overshot and the reentry guide, wherein the uphole end of the overshot is provided over the downhole end of the guide nipple and the downhole end of the reentry guide is provided over the uphole end of the guide nipple such that the uphole end of the overshot abuts the downhole end of the reentry guide at the transition; and a deployment mechanism defined on any one of the overshot, the reentry guide, or the guide nipple, the deployment mechanism being operable to connect the reentry guide to a running tool for deployment of the reentry guide tool.

2. The reentry guide tool of claim 1, wherein the grapple is a spiral grapple.

3. The reentry guide tool of claim 1, wherein an inner diameter of the bowl of the overshot is greater than or equal to an interior diameter of the tubular to be engaged.

4. The reentry guide tool of claim 1, wherein the deployment mechanism is a J-slot type mechanism comprising a J-slot profile and an actuating pin.

5. The reentry guide tool of claim 4, wherein the actuating pin comprises a circular-shaped or a diamond-shaped extension from any one of the overshot, the reentry guide, or the guide nipple.

6. The reentry guide tool of claim 4, wherein the J-slot profile is defined on the reentry guide and the actuating pin is defined on the running tool used to deploy the reentry guide.

7. The reentry guide tool of claim 1, wherein the bevel of the reentry guide comprises an angle from greater than 5 degrees from vertical to less than 50 degrees from vertical.

8. The reentry guide tool of claim 1, wherein an inner diameter of the guide nipple is less than or equal to an inner diameter of the overshot.

9. The reentry guide tool of claim 1, wherein an inner diameter of the guide nipple is less than or equal to an inner diameter of the reentry guide.

10. The reentry guide tool of claim 1, wherein the guide nipple is welded to the overshot, the reentry guide, or both.

11. The reentry guide tool of claim 1, wherein the reentry guide is threadably attached to the guide nipple.

12. A method of providing a transition from a first tubular to a second tubular in a wellbore, the method comprising:

providing a reentry guide tool having an overshot defining a lower end of the guide tool, a reentry guide defining an upper end of the guide tool, a guide nipple connecting and providing a transition between the overshot and the reentry guide, and a deployment mechanism, wherein an uphole end of the overshot is provided over a downhole end of the guide nipple and a downhole end of the reentry guide is provided over an uphole end of the guide nipple such that the uphole end of the overshot abuts the downhole end of the reentry guide at the transition provided by the guide nipple;

attaching the deployment mechanism of the reentry guide tool to a running tool;

routing the running tool with the attached guide tool into the first tubular in the wellbore to a deployment site, wherein the deployment site comprises an area in the wellbore having a transition from the first tubular to the second tubular;

attaching a grapple of the overshot of the guide tool to a location at or near the second tubular, the grapple being disposed in a bowl defining an interior space of the overshot;

providing a transition from the first tubular to the guide tool with a bevel defining an uphole end of the reentry guide; and providing a transition from the guide tool to the second tubular with the overshot.

13. The method of claim 12, further comprising disengaging the running tool from the reentry guide tool, wherein disengaging the running tool comprises guiding a male end of the deployment mechanism along a female track of the deployment mechanism such that the running tool and the reentry guide detach.

14. The method of claim 12, further comprising running a workover line from the first tubular, through the reentry guide tool, and into the second tubular.

* * * * *